US010557263B1

(12) United States Patent
Robinson

(10) Patent No.: US 10,557,263 B1
(45) Date of Patent: Feb. 11, 2020

(54) MECHANICALLY-CENTERING JOINT SEAL WITH COVER

(71) Applicant: Schul International Co., LLC, Pelham, NH (US)

(72) Inventor: Steven R. Robinson, Windham, NH (US)

(73) Assignee: Schul International Co., LLC, Hudson, NH (US)

( * ) Notice: Subject to any disclaimer, the term of this patent is extended or adjusted under 35 U.S.C. 154(b) by 0 days.

(21) Appl. No.: 16/379,181

(22) Filed: Apr. 9, 2019

(51) Int. Cl.
*E04B 1/68* (2006.01)

(52) U.S. Cl.
CPC ..... *E04B 1/6803* (2013.01); *E04B 1/6801* (2013.01)

(58) Field of Classification Search
CPC ..... E01D 19/06; E01C 11/106; E01C 11/02; E01C 11/04; E01C 11/12; E04B 1/68; E04B 1/6804; E04B 1/6803; E04B 1/6801; E04B 1/6812; E04B 1/946; E04B 1/948
USPC ..... 52/393, 395, 396.02, 396.04, 396.07, 52/396.08, 396.03, 396.06, 573.1
See application file for complete search history.

(56) References Cited

U.S. PATENT DOCUMENTS 4,533,278 A * 8/1985 Corsover ..... E01C 11/10 404/65
4,784,516 A * 11/1988 Cox ..... E01C 11/10 14/73.1
6,112,488 A * 9/2000 Olson ..... E04B 1/948 52/167.1
6,128,874 A * 10/2000 Olson ..... E04B 1/948 52/232
6,427,405 B1 * 8/2002 Moriya ..... E04B 1/68 52/396.04
7,856,781 B2 * 12/2010 Hilburn, Jr. ..... E04B 1/948 52/232
8,317,444 B1 11/2012 Hensley
8,341,908 B1 1/2013 Hensley et al.
8,365,495 B1 * 2/2013 Witherspoon ..... E04B 1/948 52/741.3
8,464,485 B2 * 6/2013 Hilburn ..... E04B 1/948 52/317
8,739,495 B1 6/2014 Witherspoon
8,813,449 B1 * 8/2014 Hensley ..... E04B 1/6804 52/396.01
8,813,450 B1 * 8/2014 Hensley ..... E04B 1/6804 52/396.01
8,826,481 B1 * 9/2014 Haydu ..... E01D 19/06 14/73.5
8,870,506 B2 10/2014 Hensley et al.
9,068,297 B2 6/2015 Hensley et al.
9,200,437 B1 12/2015 Hensley et al.
9,206,596 B1 * 12/2015 Robinson ..... E04B 1/948
9,322,163 B1 4/2016 Hensley
9,404,581 B1 8/2016 Robinson
9,528,262 B2 12/2016 Witherspoon
9,631,362 B2 4/2017 Hensley et al.
9,637,915 B1 5/2017 Hensley et al.
(Continued)

*Primary Examiner* — Brian E Glessner
*Assistant Examiner* — Adam G Barlow
(74) *Attorney, Agent, or Firm* — Crain, Caton & James, P.C.; James E. Hudson, III

(57) ABSTRACT

A system is provided for creating a joint filler or seal in the gap between adjacent panels or assemblies. The system which includes a cover plate, sealing body and mechanically-centered rib, where positioning of the rib and associated cover plate is addressed using a spring.

4 Claims, 5 Drawing Sheets

(56) References Cited

U.S. PATENT DOCUMENTS 9,644,368 B1 5/2017 Witherspoon
9,670,666 B1 6/2017 Witherspoon et al.
9,689,157 B1 6/2017 Hensley et al.
9,689,158 B1 6/2017 Hensley et al.
9,739,049 B1 8/2017 Robinson
9,739,050 B1 8/2017 Hensley et al.
9,745,738 B2 8/2017 Robinson
9,765,486 B1 * 9/2017 Robinson ..... E01C 11/126
9,803,357 B1 10/2017 Robinson
9,840,814 B2 12/2017 Robinson
9,850,662 B2 12/2017 Hensley
9,856,641 B2 1/2018 Robinson
9,951,515 B2 4/2018 Robinson
9,963,872 B2 5/2018 Hensley et al.
9,982,428 B2 5/2018 Robinson
9,982,429 B2 5/2018 Robinson
9,995,036 B1 6/2018 Robinson
10,000,921 B1 6/2018 Robinson
10,060,122 B2 * 8/2018 Robinson ..... E04B 1/6812
10,066,386 B2 9/2018 Robinson
10,066,387 B2 9/2018 Hensley et al.
10,081,939 B1 * 9/2018 Robinson ..... E04B 1/948
10,087,619 B1 10/2018 Robinson
10,087,620 B1 10/2018 Robinson
10,087,621 B1 10/2018 Robinson
10,072,413 B2 11/2018 Hensley et al.
10,125,490 B2 11/2018 Robinson
10,179,993 B2 1/2019 Hensley et al.
10,184,243 B2 * 1/2019 Hamilton ..... E01C 11/106
10,203,035 B1 2/2019 Robinson
10,213,962 B2 * 2/2019 Robinson ..... B29C 66/00
10,227,734 B1 3/2019 Robinson
10,233,633 B2 3/2019 Robinson
10,240,302 B2 3/2019 Robinson
2003/0074852 A1 * 4/2003 Knabenschuh ..... E04B 1/644 52/396.02
2004/0093815 A1 * 5/2004 Cordts ..... H02G 3/0412 52/232
2014/0219719 A1 8/2014 Hensley et al.
2014/0360118 A1 12/2014 Hensley et al.
2015/0068139 A1 3/2015 Witherspoon
2017/0130450 A1 5/2017 Witherspoon
2017/0159817 A1 6/2017 Robinson
2017/0191256 A1 7/2017 Robinson
2017/0226733 A1 8/2017 Hensley et al.
2017/0241132 A1 8/2017 Witherspoon
2017/0254027 A1 9/2017 Robinson
2017/0268222 A1 9/2017 Witherspoon et al.
2017/0292262 A1 10/2017 Hensley et al.
2017/0298618 A1 10/2017 Hensley et al.
2017/0314213 A1 11/2017 Robinson
2017/0314258 A1 11/2017 Robinson
2017/0342665 A1 11/2017 Robinson
2017/0342708 A1 11/2017 Hensley et al.
2017/0370094 A1 12/2017 Robinson
2018/0002868 A1 1/2018 Robinson
2018/0016784 A1 1/2018 Hensley et al.
2018/0038095 A1 2/2018 Robinson
2018/0106001 A1 4/2018 Robinison
2018/0106032 A1 4/2018 Robinison
2018/0119366 A1 5/2018 Robinison
2018/0142465 A1 5/2018 Robinison
2018/0148922 A1 5/2018 Robinison
2018/0163394 A1 6/2018 Robinison
2018/0171564 A1 * 6/2018 Robinson ..... E04B 1/6812
2018/0171625 A1 6/2018 Robinison
2018/0202148 A1 7/2018 Hensley et al.
2018/0238048 A1 8/2018 Robinison
2018/0266103 A1 9/2018 Robinson
2018/0274228 A1 * 9/2018 Robinson ..... E04B 1/948
2018/0300490 A1 10/2018 Robinson
2018/0363292 A1 12/2018 Robinson
2018/0371746 A1 12/2018 Hensley et al.
2018/0371747 A1 12/2018 Hensley et al.
2019/0057215 A1 2/2019 Robinson
2019/0063608 A1 2/2019 Robinson et al.
2019/0071824 A1 3/2019 Robinson
2019/0107201 A1 4/2019 Robinson
2019/0108351 A1 4/2019 Robinson
2019/0242070 A1 * 8/2019 Robinson ..... E01C 11/106

* cited by examiner

MECHANICALLY-CENTERING JOINT SEAL WITH COVER

CROSS-REFERENCE TO RELATED APPLICATIONS

None.

STATEMENT REGARDING FEDERALLY SPONSORED RESEARCH OR DEVELOPMENT

Not Applicable.

BACKGROUND

Field.

The present disclosure relates generally to systems for creating a joint filler or seal in the gap between adjacent panels or assemblies. More particularly, the present disclosure is directed to providing an expansion joint seal system which includes a cover plate and associated rib, sealing body and where positioning of the rib and associated cover plate is addressed using a spring.

Description of the Related Art.

Construction panels and other assemblies come in many different sizes and shapes and may be used for various purposes, including curtain wall, aluminum and glass panels, roadways, surfaceways, tunnels and other pre-cast structures. Because of the effects of the co-efficient of thermal expansion between similar and dissimilar materials, and external forces such as wind and seismic movement, it is necessary to form a lateral gap or joint between adjacent panels, buildings, or building sections to allow for independent movement. These gaps are also used to permit moisture to be collected and expelled. Cavity walls are common in masonry construction, typically to allow for water or moisture to condense or accumulate in the cavity or space between the two exterior walls. Collecting and diverting moisture from the cavity wall construction can be accomplished by numerous well-known systems. The cavity wall is often ventilated, such as by brick vents, to allow air flow into the cavity wall and to allow the escape of moisture heat or humidity. In addition to thermal movement or seismic joints in masonry walls, control joints are often added to allow for the known dimensional changes in masonry over time. Curtain wall or rain screen design is another common form of exterior cladding similar to a masonry cavity wall. Curtain walls can be designed to be primarily watertight but can also allow for the collection and diversion of water to the exterior of the structure. A cavity wall or curtain wall design cannot function as intended if the water or moisture is allowed to accumulate or condense in the cavity wall or behind a curtain wall or rain screen design cannot be diverted or redirected back to the outsurface of the wall. If moisture is not effectively removed it can cause damage ranging from aesthetic in the form of white efflorscence buildup on surface to mold and major structural damage from freeze/thaw cycling.

Thus, expansion and movement joints are a necessary part of all areas of construction. The size and location of the movement depends on variables such as the amount of anticipated thermal expansion, load deflection and any expected seismic activity. Joint movement in a structure can be cyclical in design as in an expansion joint or in as a control joint to allow for the shrinkage of building components or structural settling. These movement joints serve an important function by allowing a properly designed structure to move and the joint to cycle over time and to allow for the expected dimensional changes without damaging the structure. Expansion, control and movement joints are found throughout a structure from the roof to the basement, and in transitions between horizontal and vertical planes. It is an important function of there expansion joints to not only move as intended but to remain in place through their useful lifespan. This is often accomplished by extending the length and/or width of the expansion joint system over or past the edge of the gap or joint opening to attach to the joint substrate or another building component. Examples of building components that would ideal to integrally join an expansion joint with and seal would be, although not limited to, waterproofing membranes, air barrier systems, roofing systems and transitions requiring the watertight diversion of rain water. Although these joints represent only a small percentage of the building surface area and initial cost, they often account for a large percentage of waterproofing, heat loss, moisture/mold problems and other serious interior and exterior damage during the life of the building.

Conventional joint sealants like gunnable sealants and most foam seals are designed to hold the water out of they structure or expansion joint. However, water can penetrate the joint substrate in many ways such as cracks, poor sealant installation, roofing details and a porous substrate or wall component. When water or moisture enters the wall the normal sealing function of joint sealant may undesirably retain the moisture in the wall. Foam joint seals known in the art typically rely on the application of an elastomer sealant on the primary or exposed face of foam to provide the water-resistant function. Such joint seals are not waterproof, but retard the penetration of water into the joint by providing a seal between adjacent substrates for a time and under a maximum pressure. Particularly, such joint seals are not waterproof—they do not preclude water penetration under all circumstances. While this is helpful initially to keep water out of the joint and structure it does not allow for this penetrating water or moisture to escape.

Further complicating operation, some wall designs, such as cavity walls, allow for moisture to enter a first wall layer where it collects and is then directed to the outsurface of the building by flashing and weep holes. In these systems, water can sometimes be undesirably trapped in the cavity wall, such as at a mortar bridge in the wall, or other impediment caused by poor flashing selection, design or installation. When a cavity wall drainage system fails, water is retained within the structure, leading to moisture accumulating within in the wall, and to an efflorescence buildup on the exterior of the wall. This can also result in freeze-thaw damage, among other known problems.

To be effective in this environment, fully functional, foam-based joint seals require a minimum compression ratio. It is known that higher densities and ratios can provide addition sealing benefits. Cost, however, also tends to increase with overall density. There is ultimately a trade-off between compression ratio/density range and reasonable movement capabilities at about 750 kg/m$^3$. As can be appreciated, this compressed density is a product of the uncompressed density of the material and the desired compression ratio to obtain other benefits, such as water resistance. For example, a foam having an uncompressed density of 150 kg/m$^3$ uncompressed and compressed at a 5:1 ratio results in a compressed density of 750 kg/m$^3$. Alternative uncompressed densities and compression ratios may reach that compressed density of 750 kg/m$^3$ while producing different mechanical properties. It has been long known in the art that a functional foam expansion joint sealant can be constructed using a foam having an impregnation which, when uncompressed, has a density range of about 80 kg/m$^3$, which is used at a 5:1 compression ratio, resulting in a compressed density of 400 kg/m$^3$. Various impregnations are known in the art, including binders, fillers, fire-retardant impregnations, water retarding impregnations, and water reactive impregnations. Alternatively, materials may be introduced by infusion, being put into, or being included in the foam. As a further alternative, the materials may be provided as a coating. This functional foam expansion joint sealant is capable of maintaining position within a joint and its profile while accommodating thermal and seismic cycling, while providing effective sealing, resiliency and recovery. Such joint seals are not fireproof but retard the penetration of fire into the joint by providing a seal which protects the adjacent substrates or base of the joint for a time and under a maximum temperature. Particularly, such joint seals are not fireproof—they do not preclude the burning and decomposition of the foam when exposed to flame.

Another alternative known in the art for increasing performance is to provide a foam impregnated with a water resistant material at a density in the range of 120-160 kg/m$^3$, ideally at 150 kg/m$^3$ for some products, with a mean joint size compression ratio of about 3:1 with a compressed density in a range of about 400-450 kg/m$^3$, although densities in a broader range, such as 45-710 kg/m$^3$ uncompressed and installed densities, after compression and installation in the joint, of 45 kg/m$^3$ and 1500 kg/m$^3$ may also be used. These criteria ensure excellent movement and cycling while providing for fire resistance according to DIN 4112-2 F120, meeting the Conditions of Allowance under UL 2079 for a two-hour endurance, for conventional depth, without loading, with one or more movement classifications, for a joint not greater than six inches and having a movement rating as great as 100%, without a hose stream test, and an ASTM E-84 test result with a Flame Spread of 0 and a Smoke Index of 5. This density range is well known in the art, whether it is achieved by lower impregnation density and higher foam compression or higher impregnation density and a lower compression ratio, as the average functional density required for an impregnated open cell foam to provide sealing and other functional properties while allowing for adequate joint movement up to +/−50% or greater. Foams having a higher uncompressed density may be used in conjunction with a lower compression ratio, but resiliency may be sacrificed. As the compressed density increases, the foam tends to retard water more effectively and provides an improved seal against the adjacent substrates. Additives that increase the hydrophobic properties or inexpensive fillers such as calcium carbonate, silica or alumina hydroxide (ATH) provided in the foam can likewise be provided in a greater density and become more effective. Combustion modified foams such as a combustion modified flexible polyurethane foam, combustion modified ether (CME) foam, combustion modified high resilience (CMHR) foam or combustion modified Viscoelastic foam (CMVE) can be utilized in the preferred embodiments to add significant fire resistance to the impregnated foam seal or expansion joint without adding additional fire-retardant additives. Foam that is inherently fire resistant or is modified when it manufactured to be combustion or fire-resistant reduces the cost of adding and binding a fire retardant into the foam. This method has been found to be advantageous in allowing fire resistance in foam seals configured in very high compression ratios such 5:1 and higher.

By selecting the appropriate additional component, the type of foam, the uncompressed foam density and the compression ratio, the majority of the cell network will be sufficiently closed to impede the flow of water into or through the compressed foam seal thereby acting like a closed cell foam. Beneficially, an impregnated or infused open cell foam can be supplied to the end user in a pre-compressed state in rolls/reels or sticks that allows for an extended release time sufficient to install it into the joint gap. To further the sealing operation, additional components may be included. For example, additives may be fully or partially impregnated, infused or otherwise introduced into the foam such that at least some portion of the foam cells are effectively closed, or a hydrophobic or water-resistant coating is applied. However, the availability of additional components may be restricted by the type of foam selected. Closed cell foams which are inherently impermeable for example, are often restricted to a lower joint movement range such as +/−25% rather than the +/−50% of open celled foams. Additionally, the use of closed cell foams restricts the method by which any additive or fillers can be added after manufacture. Functional features such as fire resistance to the Cellulosic time-temperature curve for two hours or greater can be however be achieved in a closed cell foam seal without impacting the movement properties. Intumescent graphite powder added to a polyethylene (PE), ethylene vinyl (EVA) acetate or other closed cell foam during processing in a ratio of about 10% by weight has been found to be a highly effective in providing flexible and durable water- and fire-resistant foam seal. While intumescent graphite is preferred, other fire retardants added during the manufacture of the closed cell foam are anticipated and the ratio of known fire retardants, added to the formulation prior to creating the closed cell foam, is dependent on the required fire resistance and type of fire retardant. Open celled foams, however, present difficulties in providing water-resistance and typically require impregnation, infusion or other methods for introducing functional additives into the foam. The thickness of a foam core or sheet, its resiliency, and its porosity directly affect the extent of diffusion of the additive throughout the foam. The thicker the foam core or sheet, the lower its resiliency, and the lower its porosity, the greater the difficulty in introducing the additive. Moreover, even with each of these at optimum, the additive will likely not be equally distributed throughout the foam but will be at increased density at the inner or outer portions depending on the impregnation technique.

A known solution in the art is the use of foam segments bonded together laterally to provide a lamination. However, such lateral laminations can separate from one another, creating fissures and opening for contaminates. Moreover, because the laminations are laterally positioned, the resulting pressure exerted by the joint seal against the adjacent substrates is a function of the combined densities and thicknesses and is constant at all heights of the substrate wall.

It is also known that the thin built-up lateral laminations must be adhesively bonded to avoid separation, and therefore failure, under thermal shock, rapid cycling or longitudinal shear. Because of the cost to effectively bond the lateral laminations, a cost/performance assessment sometimes produces laminations loosely held together by the foam compression rather than by an adhesive. While this is known in the art to be somewhat effective in low performance applications and OEM assembly uses, it also known that it cannot meet the demands of high movement seismic, shear, deflection joints or where fail-safe performance is required. In light of these issues, the preferred embodiment for a high movement impregnated foam expansion joint has been found to instead be a monolithic foam design comprised of a single impregnated foam core. However, lamination systems may be desirable when the structure includes a functional component between the laminations such as a water-resistant membrane or fire-resistant layer.

Construction of lamination systems have typically been lateral composites which have been considered undesirable or inferior for a high movement or rapid cycling fire resistant expansion joint sealant. The higher compression ratios and greater volumes of fire-retardant additives are likely to cause the foam to fatigue more rapidly and to lose much of its internal recovery force. This proves problematic over time due to the anticipated exposure to movement and cycling as the impregnated foam will tend to lose its recovery force and rely more on the push-pull connection to the joint substrate. When foam laminations are vertically-oriented, the laminations can de-bond or de-laminate and separate from one another, leading to only the outer most lamination remaining attached to the joint substrate, resulting in the laminated foam joint sealant ceasing to provide either water, air or fire resistance.

A known alternative or functional supplement to the use of various impregnation densities and compression ratios is the application of functional surface coatings such as water-resistant elastomers or fire-resistant intumescents, so that the impregnated foam merely serves as a "resilient backer". Almost any physical property available in a sealant or coating can be added to an already impregnated foam sealant layering the functional sealant or coating material. Examples would include but not limited to, fire ratings, waterproofing, color, UV resistance, mold and mildew resistance, soundproofing, impact resistance, load carrying capacity, faster or slower expansion rates, insect resistance, conductivity, chemical resistance, pick-resistance and others known to those skilled in the art. For example, a sealant or coating having a rating or listing for Underwriters Laboratories 2079 may be applied to an impregnated compressed foam to create a fire-resistant foam sealant.

One approach to addressing the shortcomings has been the creation of composite materials, where the foam core—whether solid or composed of laminations of the same or differing compositions—is coated or surface impregnated with a functional layer, so that the foam is merely a resilient backer for the sealant, intumescent or coating, such that the composition and density become less important. These coatings, and the associated properties, may be adhered to the surface of each layer of a core or layered thereon to provide multiple functional properties. As can be appreciated, the composite material may have different coatings applied the different surfaces to provide desired property or properties consistent with its position. Functional coatings such as a water-resistant sealant can protect the foam core from absorbing moisture even if the foam or foam impregnation is hydrophilic. Similarly, a functional coating such as a fire-rated sealant added to the foam core or lamination with protect a foam or foam impregnation that is flammable. A biocide may even be included. This could be layered, or on opposing surfaces, or—in the case of a laminate body—on perpendicular surfaces.

Additionally, it has become desirable, and in some situations required, for the joint sealant system to provide not only water resistance, but also fire resistance. A high degree of fire resistance in foams and impregnated foam sealants is well known in the art and has been a building code requirement for foam expansion joints in Europe for more than a decade. Fire ratings such as UL 2079, DIN 4112-2, BS 476, EN1399, AS1503.4 have been used to assess performance of expansion joint seals, as have other fire resistance tests and building codes and as the basis for further fire resistance assessments, the DIN 4112 standard, for example, is incorporated into the DIN 18542 standard for "Sealing of outsurface wall joints with impregnated sealing tapes made of cellular plastics—Impregnated sealing tapes". While each testing regime utilizes its own requirements for specimen preparation and tests (water test, hose stream tests, cycling tests), the 2008 version of UL 2079, the ISO 834, BS 476: Part 20, DIN 4112, and AS 1530.4-2005 use the Cellulosic time/temperature curve, based on the burning rate of materials found in general building materials and contents, which can be described by the equation T=20+345*LOG(8*t+1), where t is time in minutes and T is temperature in C. While differing somewhat, each of these testing regimes addresses cycling and water resistance, as these are inherent in a fire-resistant expansion joint. The fire resistance of a foam sealant or expansion has been sometimes partially or fully met by infusing, impregnating or otherwise putting into the foam a liquid-based fire retardant, such as aluminum trihydrate other fire retardants commonly used to add fire resistance to foam. Unfortunately, this increases weight, alters the foam's compressibility, and may not provide the desired result without additional fire-resistant coatings or additives if a binder, such as acrylic or polyurethane, is selected to treat the foam for fire and water resistance. Doing so while maintaining movement properties may affect the foam's compressibility at densities greater than 750 kg/m$^3$, Ultimately, these specialty impregnates and infused compositions increase product cost.

It has further become desirable or functionally required to apply a fire-resistant coating to the foam joint systems to increase fire and water resistance, but often at the sacrifice of movement. Historically, fire-resistant foam sealant products that use an additional fire-resistant surface coating to obtain the life safety fire properties have been limited to only +/−25% movement capability, especially when required to meet longer time-temperature requirements such as UL2079's 2 hour or longer testing. This +/−25% movement range is too limited for most movement joints and would not meet most seismic movement and expansion joint requirements. One well-known method for utilizing these low movement fire resistant joint sealants is to increase the width or size of the joint opening, an undesirable and expensive alternative, to allow for a commonly required +/31 50% joint movement rating.

Other systems have incorporated cover plates that span the joint itself, often anchored to the concrete or attached to the expansion joint material and which are expensive to supply and install. These systems sometimes require potentially undesirable mechanical attachment, which requires drilling into the deck or joint substrate. Cover plate systems that are not mechanically attached rely on support or attachment to the expansion joint, thereby subjecting the expansion joint seal system to continuous compression, expansion and tension on the bond line when force is applied to the cover plate, which shortens the life of the joint seal system. Some of these systems use foam to provide sealing. But these foam systems can take on a compression set when the joint seal system is repeatedly exposed to lateral forces from a single direction, such as a roadway. This becomes more pronounces as these foam systems utilize a single or continuous spine along the length of the expansion joint seal system—which propagates any deflection along the length. The problems and limitations of the current foam sealing cover plate systems that rely on a continuous spline are well known in the art.

These cover plate systems are designed to address lateral movement—the expansion and compression of adjacent panels. Unfortunately, these do no properly address vertical shifts—where the substrates become misaligned when the end of one shifts vertically relative to the other. In such situations, the components attached to the cover plate are likewise rotated in space causing a pedestrian or vehicular hazard. The current systems do not adequately address the differences in the coefficient of linear expansion between the cover plate and the substrate or allow for curved joint designs. The inability of the current art to compensate for the lateral or thermal movement of the cover plate results in failure of attachment to the cover plate or additional pressure being imposed on one half of the expansion joint system and potentially pulling the expansion joint system away from the lower substrate.

It would be an improvement to the art of provide an expansion joint seal wherein positioning of the rib and associated cover plate is addressed using a spring.

SUMMARY

The present disclosure therefore meets the above needs and overcomes one or more deficiencies in the prior art. The disclosure provides an expansion joint seal for use in an expansion joint, where the expansion joint has a first substrate separated from a second substrate by a joint width, where the expansion joint seal includes a cover plate, a rib, a resilient compressible body, and a resilient spacing member. The cover plate has a cover plate length between a cover plate front surface and a cover plate back surface and a cover plate width between a cover plate first surface and a cover plate second surface, where the cover plate width is greater than the joint width. The rib has a rib width between a rib first surface and a rib second surface, a rib height between a rib top surface and a rib bottom surface, and a rib length between a rib front surface and a rib back surface, where the rib length is not greater than the cover plate length. The resilient compressible body has a body uncompressed width between a body first outer surface and a body second outer surface, a body length between a body front surface and a body back surface, a body height between a body bottom surface and a body top surface. The body further has a body first section and a body second section. The body uncompressed width is greater than the joint width and the body length is not greater than the cover plate length. The body first section has a body first section first surface adapted to contact a first substrate wall, and a body first section second surface having a body second section second surface adapted to contact a second substrate wall, and a body second section first surface. The rib first surface is in contact with at least a portion of the body first section second surface and the rib second surface is in contact with at least a portion of the body second section first surface. The rib top surface is detachably fixed in relation to the cover plate. The resilient spacing member has a resilient spacing member uncompressed width between a resilient spacing member uncompressed first outer surface and a resilient spacing member uncompressed second outer surface, where the resilient spacing member uncompressed width is greater than the joint width. The resilient spacing member further has a resilient spacing member length not greater than the cover plate length, has a resilient spacing member accordion profile across the resilient spacing member uncompressed width and is adapted to contact to the rib adjacent the cover plate.

Additional aspects, advantages, and embodiments of the disclosure will become apparent to those skilled in the art from the following description of the various embodiments and related drawings.

BRIEF DESCRIPTION OF THE DRAWINGS

So that the manner in which the described features, advantages, and objects of the disclosure, as well as others which will become apparent, are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DETAILED DESCRIPTION

The present disclosure provides an expansion joint system. As can be appreciated, sealants coatings, functional membranes, adhesives and other functional materials may be applied to or included within the components of the disclosure.

Figure 1:
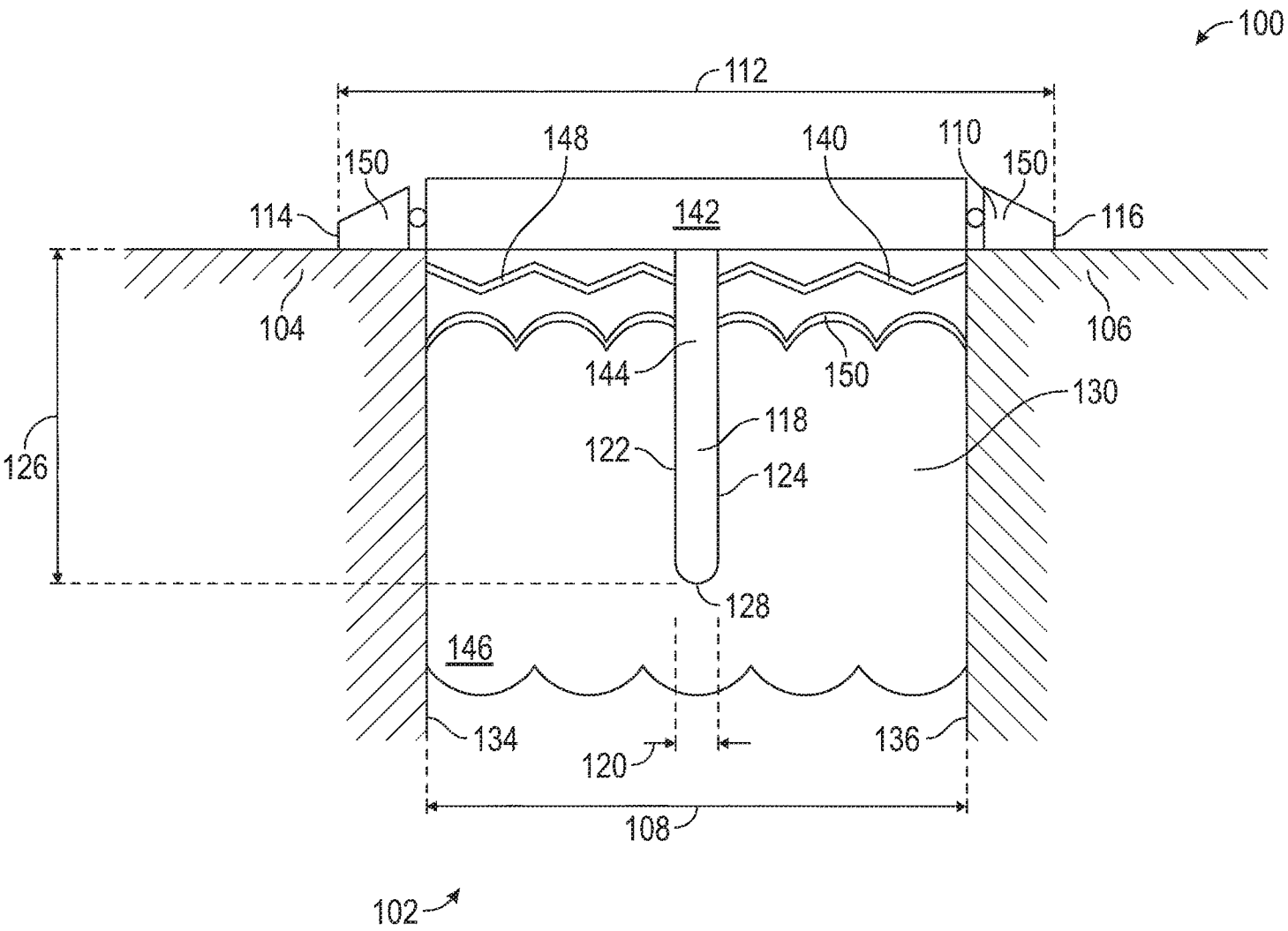
FIG. 1 illustrates at end view of a joint seal system according to the present disclosure when installed.

Referring to FIG. 1, an expansion joint seal 100 is disclosed for use in an expansion joint 102 and shown after installation. The expansion joint 102 has a first substrate 104 separated from a second substrate 106 by a joint width 108, where first substrate 104 has a first substrate wall 134 and the second substrate 106 has a second substrate wall 136. The expansion joint seal is provided which includes a cover plate 110, at least one rib 118, a body 130 of a resilient compressible material, and a resilient spacing member 140.

Figure 6:
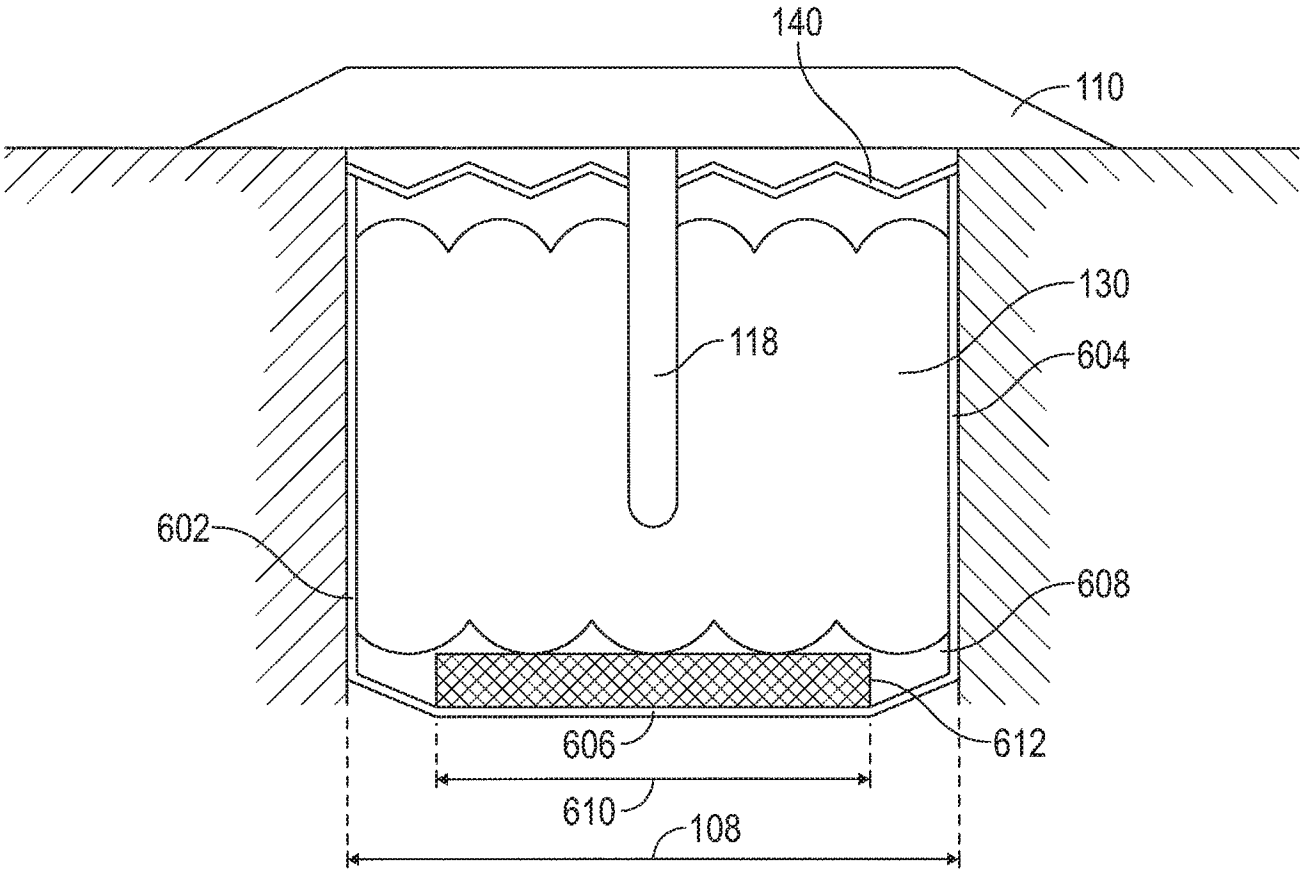
FIG. 6 illustrates an alternative end view of a joint seal system according to the present disclosure.

The cover plate 110 is preferably made of a material sufficiently resilient to sustain and be generally undamaged by the surface traffic atop it for a period of at least five (5) years and of a material and thickness sufficient to transfer any loads to the substrates which it contacts and may have limited compressibility and has a cover plate front surface 142. The cover plate 110 may be provided to present a solid, generally impermeable surface, or may be provided to present a permeable surface. The cover plate 110 has a cover plate width 112 a cover plate first surface 114 and a cover plate second surface 116. To perform its function when positioned atop the expansion joint, and to provide a working surface, the cover plate width 112 typically is greater than joint width 108. Regardless of the intended position, the cover plate 120 may be constructed without restriction as to its profile. The cover plate 120 may be constructed of a single plate as illustrated in FIG. 1. Referring to FIG. 6, the cover plate 120 may be constructed of multiple cover plate layers 610, providing a wear surface 612 on its top, which may be removable, and enabling repair or replacements of wear surfaces without replacing the entire cover plate 110. Multiple layers 610 may be advantageous in environments wherein the cover plate will be subjected to strikes, such as by a snow plow or where the material of cover plate 110 may suffer from environmental exposure, such as in desert conditions. Each layer 610 is selected from a durable material which may be bonded or adhered to an adjacent layer 610, but which may be separated by the adjacent layer 610 upon the desired minimum lateral force.

In some cases, it may be beneficial for the cover plate 110 to include a hinged ramp 150 to provide a surface adjustment should the substrates 104, 106 become unequal in vertical position, such as if one substrate is lifted upward. A hinged ramp 150 ensures that a usable surface is retained, even when the substrates 104, 106 cease to be co-planer, from the first substrate 104, to the cover plate 110, through to the second substrate 106.

The cover plate 110 may also be sized for imposition into a concrete or polymer nosing, allowing for a generally-flat surface for snow plowing. The cover plate 110 may be affixed to the first substrate 104 and/or the second substrate 106 at the substrates surface or any point below. The cover plate width 112 may be less than the joint width 108 so the cover plate 110 may be installed flush or below the top of a substrate 104, 106 and/or installed flush or below the surface of substrate a 104, 106. The contact point for cover plate 110 may be the deck or wall substrate or may be a polymer or elastomeric material to reduce wear and to facilitate the movement function of the cover plate 110.

Referring again to FIG. 1, associated with the cover plate 110 is the rib 118, which may be fixedly attached to or integrally made a part of the cover plate 110 so the two components function as a single unit and has a rib front surface 144. Alternatively, the rib 118 may be hingedly or slidably attached to the cover plate 110 to permit some variation in orientation or position. The rib 118 may be constructed in one or in multiple pieces, which may permit greater flexing or which may permit attachment and contact with the cover plate 110 at one diameter and with the body 130 at a different diameter. The rib 118 has a rib width 120 between a rib first surface 122 and a rib second surface 124 and has a rib bottom surface 128, which may be flat, curved or pointed and a rib height 126. The rib 118 may be constructed of a durable material, such as metal, carbon fiber, or plastics.

The body 130 of a resilient compressible material is adapted to contact the first substrate wall 134 and the second substrate wall 136 while in compression and is associated with the rib 118, which penetrates into the body 130 to a depth sufficient to retain the rib 118 and to cause deflection of the rib 118. As illustrated in FIG. 1, the body has a body front surface 146. Body 130 may be composed of a foam, a corn starch-based material, cellulose or other compressible material. The compression resistance, stiffness or durometer of the body 130 may be non-uniform, with a greater value on one side of the rib 118, to allow for directional traffic or resistance to other lateral forces.

The resilient spacing member 140 is adapted to contact to the rib 118 adjacent the cover plate 110. The resilient spacing member 140 may be a sheet or strip and may be affixed about the rib 118 or may surround with an initial gap to permit some movement before the application of force by the resilient spacing member 140 upon contact by the rib 118. As illustrated in FIG. 1, the resilient spacing member 140 has a resilient spacing member front surface 148.

Figure 2:
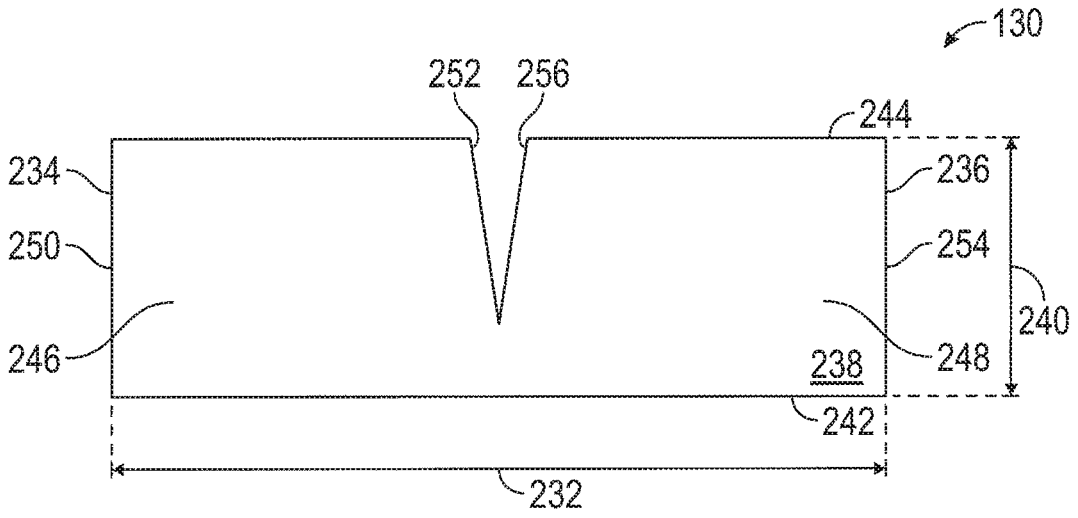
FIG. 2 illustrates an isometric view of the body of resilient compressible material for use in the joint seal system according to the present disclosure.

Referring to FIG. 2, an isometric view of the body 130 of resilient compressible material for use in the joint seal system according to the present disclosure is illustrated. The body 130 of a resilient compressible material has a body uncompressed width 232 between a body first outer surface 234 and a body second outer surface 236. The body uncompressed width 232 is greater than the joint width 108 illustrated in FIG. 1. The body 130 further has a body height 240 between a body bottom surface 242 and a body top surface 244. The body 130 may include a body first section having a body first section first surface 250 adapted to contact the first substrate wall 134 and the same as the body first outer surface 234, and a body first section second surface 252 to contact the rib 118 at the rib first surface 122. Because the rib 118 need not pierce entirely through the body 130, the body first section second surface 252 may have less surface area that the body first section first surface 250. The body 130 may also include a body second section 248 having a body second section second surface 254 adapted to contact a second substrate wall 136 and the same as the body second outer surface 236, and a body second section first surface 256. Preferably, the rib bottom surface 128 is positioned between the body bottom surface 242 and a body top surface 244, but may, when desired, pierce entirely through the body 130. As illustrated in FIG. 2, the body has a body rear end 238. Further, when desired, the body 130 may be constructed of two or more pieces of foam, each with its own mechanical properties, which may result in compressibility varying depending on direction. Moreover, the rib 118 need not be positioned at a lateral midpoint of the body 130 and may be offset to accommodate an intended direction of likely strikes to the cover plate 110.

Referring to FIG. 1, when the joint seal 100 is assembled, the rib first surface 122 contacts at least a portion of the body first section second surface 252 and the rib second surface 124 is in contact with at least a portion of the body second section first surface 256.

Figure 3:
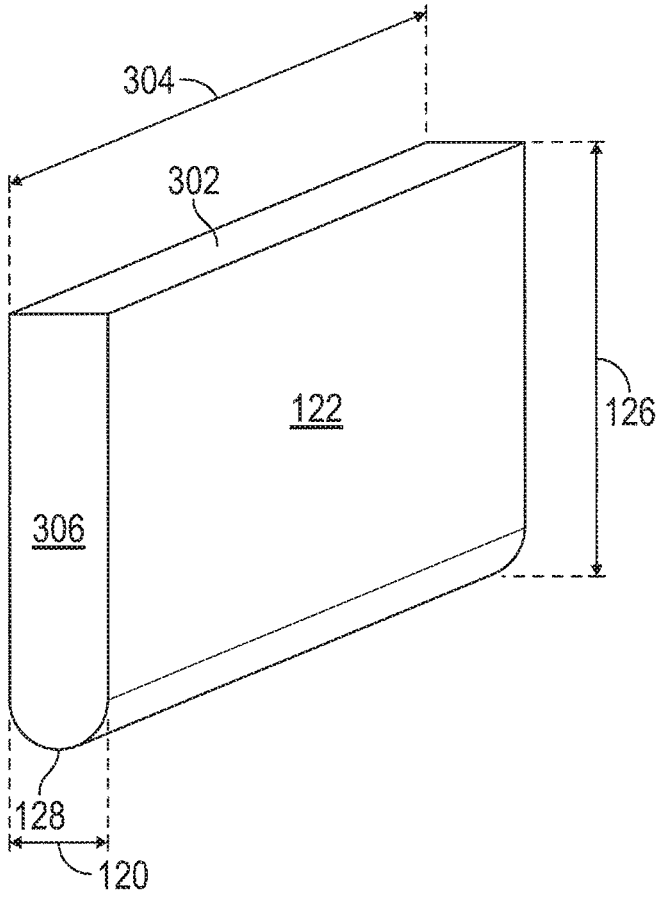
FIG. 3 illustrates an isometric view of the rib for use in the joint seal system according to the present disclosure from its rear side.

Referring to FIG. 3, an isometric view of a rib 118 for use in the joint seal system according to the present disclosure is illustrated from its rear side. While more than one rib 118 may be used, each rib 118 is preferably within a common size. Each rib 118 has a rib height 126 between a rib top surface 302 and a rib bottom surface 128 and a rib length 304 between the rib front surface 144 and rib back surface 306. When the joint seal 100 is assembled, the rib top 302 surface is detachably fixed in relation to the cover plate 110.

Figure 4:
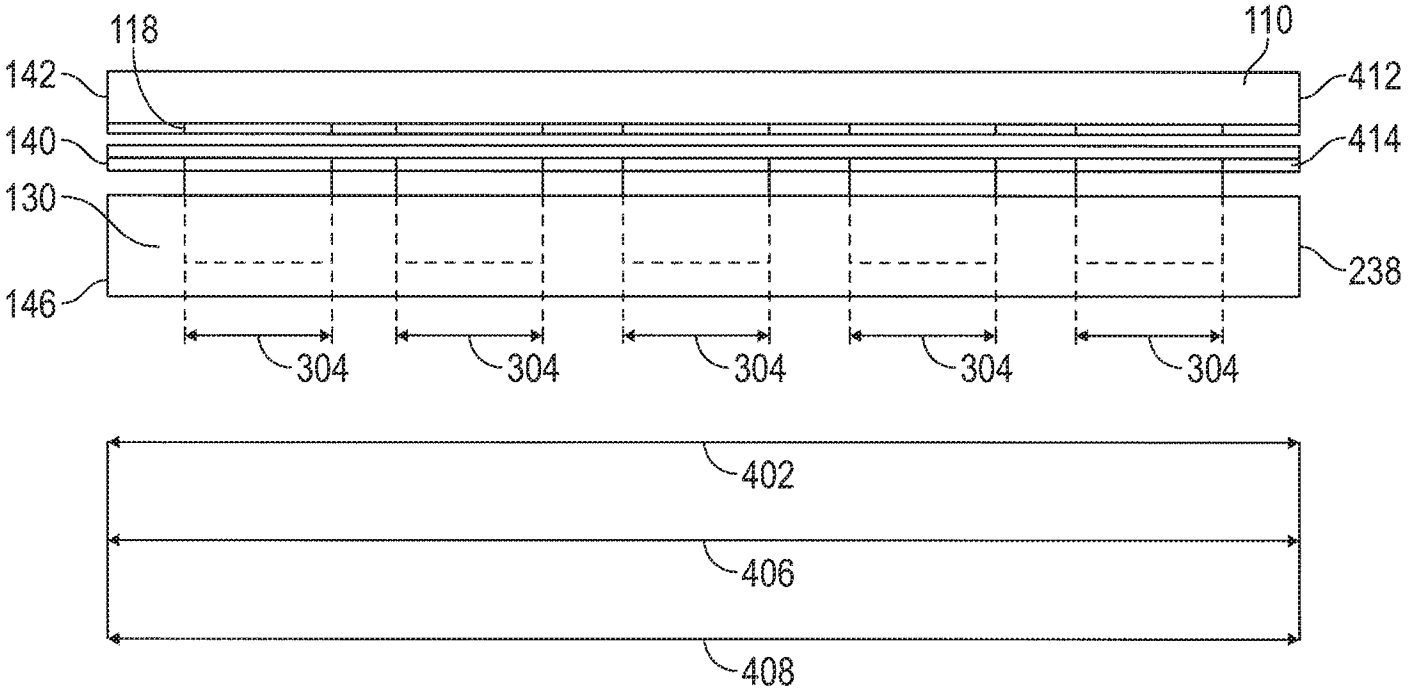
FIG. 4 illustrates a side view of a joint seal system according to the present disclosure.

Referring to FIG. 4, a side view of a joint seal system according to the present disclosure is provided. Referring to FIGS. 1-4, the cover plate 110 has a cover plate length 402 between the cover plate front surface 142 and a cover plate back surface 412. The rib length 304 is not greater than the cover plate length 402. The body 130 has a body length 406 between a body front surface 146 and the body back surface 238, which is preferably not greater than the cover plate length 402. The body length 406 may be greater that the cover plate length 402 when the body 130 is to be compressed longitudinally, i.e. along the longest axis of the cover plate 110. The resilient spacing member 140 likewise has a resilient spacing member length 408 preferably not greater than the cover plate length 402. However, when desired, the resilient spacing member 140 can be positioned, or be longer, so as to extend beyond the cover plate 110 and therefore provide a point of connection to an adjacent joint seal 100. Similarly, the body 130 may be positioned, or be longer, so as to extend beyond the cover plate 110 and therefore provide a point of connection to an adjacent joint seal 100.

Figure 5:
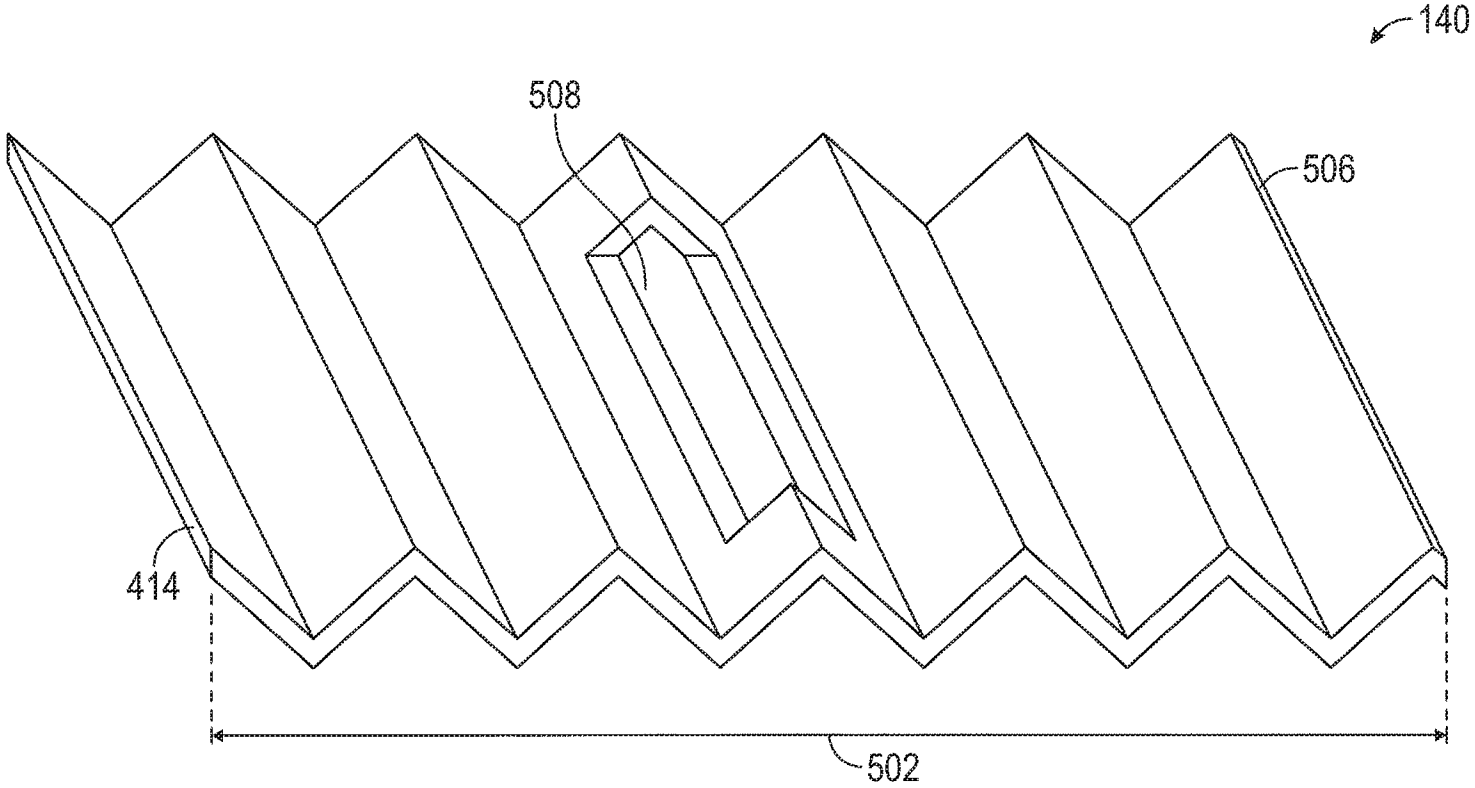
FIG. 5 illustrates an isometric view of the resilient spacing member for use in the joint seal system according to the present disclosure from its rear side.

Referring to FIG. 5, an isometric view of the resilient spacing member for use in the joint seal system according to the present disclosure is illustrated from its rear side. The resilient spacing member 140 has a resilient spacing member uncompressed width 502 between a resilient spacing member uncompressed first outer surface 414, illustrated in FIG. 4, and a resilient spacing member uncompressed second outer surface 506. The resilient spacing member uncompressed width 502 is greater than the joint width 108. The resilient spacing member 140 having a resilient spacing member accordion profile across the resilient spacing member uncompressed width 502 and is adapted to surround and contact to the rib 118 adjacent the cover plate 110 at a rib opening 508. The resilient spacing member 140 may be continuous, may provide additional sealing and may introduce or support other mechanical properties in the joint seal 100. When desired, the resilient spacing member 140 may be configured to permit removal and replacement without requiring the replacement of the body 130.

Referring to FIG. 6, an alternative end view of a joint seal system according to the present disclosure is illustrated. The resilient spacing member 140 is configured to provide a contained structure for the joint seal 100. The resilient spacing member 140 may be associated with a resilient spacing member first surface member 602, a resilient spacing member second surface member 604, and a resilient spacing member bottom member 606. The resilient spacing member first surface member 602 and the resilient spacing member second surface member 604 downwardly depend from the resilient spacing member 140 and are each attached to the resilient spacing member bottom member 606, forming a spacing enclosure 608 surrounding the body 130 of a resilient compressible material. The spacing enclosure 608 may be sized for imposition, such as by providing the resilient spacing member bottom member 606 with a resilient spacing member bottom member width 610 less than the 108, resulting in a beveled or bowed bottom. When desires, a fire-retardant body 612 may be positioned intermediate the resilient spacing member bottom member 606 and the body 130 of a resilient compressible material.

the body 130 may be a foam member or may be a non-foam material which exhibits similar properties of compressibility, expansion, resiliency, and to support liquid-based additives, such a fire retardants and fillers. The body 130 should preferably be composed of an elastically compressible, though materials which are not elastic and/or not compressible may be used. Whether constructed of one or pieces of the same foam or of different foams, the body 130 has body specific properties, including a first core body density and a first core body spring force.

The joint seal 100 may be provided with end profiles intended to provide interlocking faces so a plurality of joint seals 100 may be installed in abutment.

A coating 150 is adjacent the body top surface 244 and may provide water resistance and/or fire retardancy selected to provide to slow the spread of fire. The coating 150 may undergo chemical reaction when heated to reduce flammability or delay combustion or cool through physical action or endothermic reactions. The coating 150 may provide retardancy through endothermic degradation, such as by use of aluminum hydroxide. The coating 150 may provide retardancy through thermal shielding, such as by use of an intumescent, which chars over when burned, separating the flame from the material and slowing heat transfer. The coating 150 may provide retardancy by gas phase radical quenching, such as when chlorinated paraffin undergoes thermal degradation and releases hydrogen chloride to lower potential propagation of combustion reactions. The coating 150 may extend to one or more of the body first outer surface 234, the body second outer surface 236, the body front surface 238 and the body back surface 414.

While the coating 150 is adjacent a body 130 and preferably thereby contacts the body 130, there may be minimal separation caused by the imposition of a further layer or membrane.

When body 130 is to be constructed of foam, any of various types of foam known in the art may be, including compositions such as polyurethane and polystyrene, and may be open or closed cell. The uncompressed density of the body 130 may also be altered for performance, depending on local weather conditions. The density of the body 130 when relaxed and prior to any compression may be less 400 kg/m$^3$. When desired, the first core body 130 may be selected of a composition which is fire retardant or water resistant.

The body 130 may be a foam, such as an open cell foam, a lamination of open cell foam and closed cell foam, and closed cell foam. When desired, the body 130 may have a treatment, such as impregnation, to increase desirable properties, such as fire resistance or water resistance, by, respectively, the introduction of a fire retardant into the foam or the introduction of a water inhibitor into the foam. Further, the body 130 may be composed of a hydrophilic material, a hydrophobic material, a fire-retardant material, or a sintering material.

Moreover, the material for the body 130 may be selected from partially closed cell or viscoelastic foams. Most prior art foams seals have been designed as "soft foam" pre-compressed foam seals utilizing low to medium density foam (about 16-30 kg/m$^3$) and softer foam (ILD range of about 10-20). It has been surprisingly found through extensive testing of variations of foam densities and foam hardness, fillers and elastic impregnation compounds that higher density "hard" foams with high ILD's can provide an effective foam seal meeting the required waterproofing (600 Pa minimum and ideally 1000 Pa or greater) and movement and cycling requirements such as ASTM E-1399 Standard Test Method for Cyclic Movement and Measuring the Minimum and Maximum Joint Widths of Architectural Joint Systems as well as long term joint cycling testing. An advantage has been found in using higher density and higher hardness (higher ILD) foams particularly in horizontal applications. While at first this might seem obvious it is known in the art that higher density foams that are about 32-50 kg/m$^3$ with an ILD rating of about 40 and greater tend to have other undesirable properties such as a long term decrease in fatigue resistance. Desirable properties such as elongation, ability to resist compression set, foam resiliency and fatigue resistance typically decline relative to an increase in density and ILD. These undesirable characteristics are often more pronounced when fillers such as calcium carbonate, melamine and others are utilized to increase the foam density yet the cost advantage of the filled foam is beneficial and desirable. Similarly, when graft polyols are used in the manufacture of the base foam to increase the hardness or load carrying capabilities, other desirable characteristics of the base foam such as resiliency and resistance to compression set can be diminished. Materials that have reduced tack or adhesive properties after cure and which provide a high internal recovery force can be used to counteract the long-term fatigue resistance of the high density, high ILD foams. It may be beneficial to first impregnate and cure the foam with the injected or impregnated silicone, acrylic, urethane or other low tack polymers and, ideally, elastomers with about 100-200% elongation or greater providing a sufficient internal recovery force, then re-impregnating the foam with another elastomer or binder to provide a timed expansion recovery at specific temperatures. The impregnation materials with higher long-term recovery capabilities imparted to the high density, high ILD base foams, such as a silicone or urethane elastomers, can be used to impart color to the foam seal or be a clear or translucent color to retain the base foam color. If desirable a second impregnation, partial impregnation or coating can be applied to or into the foam seal to add additional functional characteristics such as UV stability, mold and mildew resistance, color, fire-resistance or fire-ratings or other properties deemed desirable to functionality to the foam.

Viscoelastic foams have not typically been commercially available or used for foam seals due to perceived shortcomings. Commonly used formulations, ratios and methods do not provide a commercially viable foam seal using viscoelastic foam when compared to standard polyurethane foams. Open cell viscoelastic foams are more expensive than polyester or polyether polyurethane foams commonly used in foam seals. Any impregnation process on a viscoelastic foam tends to proceed slower than on a traditional foam due to the fine cell structure of viscoelastic foam. This can be particularly frustrating as the impregnation materials and the impregnation process are typically the most expensive component of a foam seal. However, because of their higher initial density viscoelastic foams can provide better load carrying or pressure resistant foam seal. Both properties are desirable but not fully provided for in the current art for use in applications such as load carrying horizontal joints or expansion joints for secondary containment. Common densities found in viscoelastic foams are 64-80 kg/m$^3$ or greater. Additionally, viscoelastic foams have four functional properties (density, ILD rating, temperature and time) compared to flexible polyurethane foams, which have two primary properties (density and an ILD rating).

However, the speed of recovery of viscoelastic foams following compression may be increased by reducing or eliminating any impregnation, surface impregnation or low adhesive strength impregnation compound. Incorporating fillers into the impregnation compound is known to be effective in controlling the adhesive strength of the impregnation binder and therefore the re-expansion rate of the impregnated foam. By surface impregnating or coating the outside surface of one or both sides of viscoelastic foam to approximately 10% of the foam thickness, such as about 3-8 mm deep for conventional joint seals, the release time can be controlled and predicted based on ambient temperature. Alternatively, the foam can be infused, partially impregnated or impregnated with a functional or non-functional filler without a using binder but rather only a solvent or water as the impregnation carrier where the carrier evaporates leaving only the filler in the foam.

The re-expansion rate of a seal using viscoelastic foam may be controlled by using un-impregnated viscoelastic foam strips and re-adhering them with a pressure sensitive adhesive or hot melt adhesive. When the seal is compressed, the laminating adhesive serves as a temporary restriction to re-expansion allowing time to install the foam seal. Viscoelastic foam may be advantageously used, rather than standard polyurethane foam, for joints requiring additional softness and flexibility due to higher foam seal compression in hot climates or exposure or increased stiffness in cold temperatures when a foam seal is at its minimum compressed density. Additionally, closed cell, partially closed cell and other foams can be used as in combination with the viscoelastic foams to reduce the overall cost.

This second group of body materials, the non-foam members, may include, for example, corrugated cardboards, natural and man-made batting materials, and natural, synthetic and man-made sponge material. When desired, such materials may be selected for properties, such as water leakage, air leakage, resilience in face of one or more cycling regimes, compressibility, relaxation rate, compression set, and elasticity.

The material for the body 130 may be altered to provide additional functional characteristics. It may be infused, impregnated, partially impregnated or coated with an impregnation material or binder that is designed specifically to provide state of the art seal water -resistance properties with a uniform and consistent distribution of the waterproofing binder. The body 130 may be infused or impregnated or otherwise altered to retain a fire retardant, dependent on function. Where the body 130 is foam, any suitable open cell foam type with a density of 16-45 kg/m$^3$ or higher can provide an effective water-resistant foam-based seal by varying the impregnation density or the final compression ratio. Where a sound resistant seal is desired, the density or the variable densities provide a sound resistant seal in a similarly-rated wall from a Sound Transmission Class value from 42-63 and/or a sound reduction between 12 and 50 decibels.

The body 130 may be selected from an inherently hydrophilic material or have a hydrophilic component such as a hydrophilic polymer that is uniformly distributed throughout. The body 130 may include strategically-placed surface impregnation or partially impregnate with a hydroactive polymer. Because the primary function of the body 130 is waterproofing, the addition of a hydrophilic function does not negatively impact any desired fire-resistant properties, as an increase moisture content in the body 130 may increase fire resistive properties.

The body 130 may be formed of commercially available vapor permeable foam products or by forming specialty foams. Commercial available products which provide vapor permeable and excellent fire-resistant properties are well known, such as Sealtite VP or Willseal 600. It is well known that a vapor permeable but water-resistant foam joint sealant may be produced leaving at least a portion of the cell structure open while in compression such that water vapor can escape through the impregnated foam sealant. Water is then ejected on the exterior of a body 130 because the foam, and/or any impregnation, is hydrophobic and therefore repels water. Water can escape from the foam sealant or wall cavity through water vapor pressure by virtue of the difference in humidity creating unequal pressure between the two areas. Because the cell structure is still partially open the vapor pressure drive is sufficient to allow moisture to return to equalization or the exterior of the structure. By a combination of compression ratio and impregnation density of a hydrophobic component the water resistance capacity can be increased to provide resistance to various levels of pressure or driving rain.

The body 130 may include an impregnate, such as a fire retardant such as aluminum trihydroxide, which may be throughout its entirety or which may be only about ten percent of the body uncompressed width 232. Additional function properties can be added by surface impregnating the exposed or outside surfaces of the foam as well as the inside portion if additional properties are desirable.

Beneficially, because the coating 150 may provide fire resistance, the present disclosure provides for an expansion joint sealant without the need to impregnate the body 130 with a fire retardant.

An adhesive may be applied to one or more of the body first outer surface 234 and a body second outer surface 236.

The body 130 may contain, such as by impregnation or infusion, a sintering material, wherein the particles in the impregnate move past one another with minimal effort at ambient temperature but form a solid upon heating. Once such sintering material is clay or a nano-clay. Such a sintering impregnate would provide an increased overall insulation value and permit a lower density at installation than conventional foams while still having a fire endurance capacity of at least one hour, such as in connection with the UL 2079 standard for horizontal and vertical joints. While the cell structure, particularly, but not solely, when compressed, of body 130 preferably inhibits the flow of water, the presence of an inhibitant or a fire retardant may prove additionally beneficial. The fire retardant may be introduced as part of the foaming process, or by impregnating, coating, infusing, or laminating, or by other processes known in the art.

Further modifications, identified in art, may be made to the present disclosure. The joint seal 100 may further include an insulating layer, such as a silicate, atop the body 130 and/or the coating 160 to add a refractory of insulating function. However, such a layer, unless otherwise selected, would not be a fire-retardant liquid glass formulation. The exposed top surface may be coated or partially coated with a flexible or semi-rigid elastomer to increase load carrying capability which is further enhanced by the supporting intumescent members. These, or other coatings, may be used to provide waterproofing, fire resistance, or additional functional benefits.

The present disclosure may further incorporate a membrane, such as vapor impermeable layer, for further benefits. The membrane may be positioned between any two core bodies and provides a barrier to foreign matter penetrating through the joint seal 100 and to opposing surface of the joint, thus ensuring some portion of the core bodies are not susceptible to contaminants and therefore continue to function. As one or more core bodies may be composed of a vapor permeable foam, such a composition becomes particularly beneficial when a barrier or membrane is present. The membrane may thus may retain an then expel moisture, preventing moisture from penetrating in an adjacent substrate. As can be appreciated, to be effective, the membrane is preferably sized to be no smaller in any dimension than the body 130. Alternatively, the membrane may extend beyond the core bodies to provide a surface which may contact an adjacent substrate and even overlap its top. The membrane 104 may be intumescent or may otherwise provide fire retardancy in the joint seal 100. Consistent with uses known in the art, the present disclosure may be associated with a central non-conductive spine and cover plate assembly for those uses wherein high traffic is anticipated, as well as for compliance with Department of Transportation requirements. The present invention may be adapted for use with other expansion joint systems, such those that incorporate a rib or spline within or connection to a body such as core bodies and attached or associated, permanently or detachably with a cover plate.

Other variations may be employed. The joint seal 100 may be constructed to withstand a hydrostatic pressure equal to or greater than 29.39 psi. Environmentally friendly foam, fillers, binders, elastomer and other components may be selected to meet environmental, green and energy efficiency standards. The body 130 may exhibit auxetic properties to provide support or stability for the joint seal 100 as it thermally cycles or to provide additional transfer loading capacity. Auxetic properties may be provided by the body material, the internal components such as the members/membrane or by an external mechanical mechanism. The body 130 may have a rigid or semi-rigid central core equal to 5-65% of the first core body width 118, second core body width 127, or third core body width 137. The body 130 may have a central core rigid through normal joint cycling, typically +/−25%, but collapsible under seismic (+/−50%) joint cycling. The body 130 may have a central core both rigid and collapsible and coupled with a data feedback system where sensors collect data can supplies information to be stored internally or externally.

Additionally, when desired, a sensor may be included and may contact one of more of the component of the joint seal system 100. The sensor may be a radio frequency identification device (RFID), transponder, or other wirelessly transmitting sensor. A sensor may be beneficial to assess the health of a joint seal 100 without accessing the interior of the expansion joint, otherwise accomplished by removal of the cover plate. It may identify when a failure occurs and thus provide an integral failure detection system. The failure detection system may be continuously or intermittently monitored and may provide feedback by powered, radio or inductive methods which may have an active or passive feedback system. It may alternatively provide environmental data, including air or water contamination. Such sensors are known in the art, and which may provide identification of circumstances such as moisture penetration and accumulation. The inclusion of a sensor in the joint seal 100 may be particularly advantageous in circumstances where the joint seal 100 is concealed after installation, particularly as moisture sources and penetration may not be visually detected. Thus, by including a low cost, moisture-activated or sensitive sensor at the third core body bottom surface 132, the user can scan the joint seal 100 for any points of weakness due to water penetration. A heat sensitive sensor may also be positioned within the joint seal 100, thus permitting identification of actual internal temperature, or identification of temperature conditions requiring attention, such as increased temperature due to the presence of fire, external to the joint or even behind it, such as within a wall. Such data may be particularly beneficial in roof and below grade installations where water penetration is to be detected as soon as possible.

Inclusion of a sensor in the joint seal 100 may provide substantial benefit for information feedback and potentially activating alarms or other functions within the joint seal 100 or external systems. Fires that start in curtain walls are catastrophic. High and low-pressure changes have deleterious effects on the long-term structure and the connecting features. Providing real time feedback and potential for data collection from sensors, particularly given the inexpensive cost of such sensors, in those areas and particularly where the wind, rain and pressure will have their greatest impact would provide benefit. While the pressure on the wall is difficult to measure, for example, the deflection in a pre-compressed sealant is quite rapid and linear. Additionally, joint seals are used in interior structures including but not limited to bio-safety and cleanrooms. Additionally, a sensor could be selected which would provide details pertinent to the state of the Leadership in Energy and Environmental Design (LEED) efficiency of the building. Additionally, such a sensor, which could identify and transmit air pressure differential data, could be used in connection with masonry wall designs that have cavity walls or in the curtain wall application, where the air pressure differential inside the cavity wall or behind the cavity wall is critical to maintaining the function of the system. A sensor may be positioned in other locations within the joint seal 100 to provide beneficial data. A sensor may be positioned within the body 130 at, or near, the body top surface 244 to provide prompt notice of detection of heat outside typical operating parameters, so as to indicate potential fire or safety issues. Such a positioning would be advantageous in horizontal of confined areas. A sensor so positioned might alternatively be selected to provide moisture penetration data, beneficial in cases of failure or conditions beyond design parameters. The sensor may provide data on moisture content, heat or temperature, moisture penetration, and manufacturing details. A sensor may provide notice of exposure from the surface of the joint seal 100 most distant from the base of the joint. A sensor may further provide real time data. Using a moisture sensitive sensor in the joint seal 100 and at critical junctions/connections would allow for active feedback on the waterproofing performance of the joint seal 100. It can also allow for routine verification of the watertightness with a handheld sensor reader to find leaks before the reach occupied space and to find the source of an existing leak. Often water appears in a location much different than it originates making it difficult to isolate the area causing the leak. A positive reading from the sensor alerts the property owner to the exact location(s) that have water penetration without or before destructive means of finding the source. The use of a sensor in the joint seal 100 is not limited to identifying water intrusion but also fire, heat loss, air loss, break in joint continuity and other functions that cannot be checked by non-destructive means. Use of a sensor on or within the body 130 or elsewhere in the joint seal 100 may provide a benefit over the prior art. Impregnated foam materials, which may be used for the body 130, are known to cure fastest at exposed surfaces, encapsulating moisture remaining inside the body, and creating difficulties in permitting the removal of moisture from within the body. While heating is a known method to addressing these differences in the natural rate of cooling, it unfortunately may cause degradation of the foam in response. Similarly, while forcing air through the foam bodies may be used to address the curing issues, the potential random cell size and structure impedes airflow and impedes predictable results. Addressing the variation in curing is desirable as variations affect quality and performance properties. The use of a sensor within or on the body 130 or elsewhere in the joint seal 100 may permit use of the heating method while minimizing negative effects. The data from the sensors, such as real-time feedback from the heat, moisture and air pressure sensors, aids in production of a consistent product. Moisture and heat sensitive sensors aid in determining and/or maintaining optimal impregnation densities, airflow properties of the foam during the curing cycle of the foam impregnation. Placement of the sensors into foam at the pre-determined different levels allows for optimum curing allowing for real time changes to temperature, speed and airflow resulting in increased production rates, product quality and traceability of the input variables to that are used to accommodate environmental and raw material changes for each product lots.

The selection of components providing resiliency, compressibility, water-resistance and fire resistance, the joint seal 100 may be constructed to provide sufficient characteristics to obtain fire certification under any of the many standards available. In the United States, these include ASTM International's E 814 and its parallel Underwriter Laboratories UL 1379 "Fire Tests of Through-penetration Firestops," ASTM International's E1966 and its parallel Underwriter Laboratories UL 2079 "Tests for Fire-Resistance Joint Systems," ASTM International's E 2307 "Standard Test Method for Determining Fire Resistance of Perimeter Fire Barrier Systems Using Intermediate-Scale, Multistory Test Apparatus, the tests known as ASTM E 84, UL 723 and NFPA 255 "Surface Burning Characteristics of Building Materials," ASTM E 90 "Standard Practice for Use of Sealants in Acoustical Applications," ASTM E 119 and its parallel UL 263 "Fire Tests of Building Construction and Materials," ASTM E 136 "Behavior of Materials in a Vertical Tube Furnace at 750° C." (Combustibility), ASTM E 1399 "Tests for Cyclic Movement of Joints," ASTM E 595 "Tests for Outgassing in a Vacuum Environment," ASTM G 21 "Determining Resistance of Synthetic Polymeric Materials to Fungi." Some of these test standards are used in particular applications where firestop is to be installed.

Most of these use the Cellulosic time/temperature curve, described by the known equation T=20+345*LOG(8*t+1) where t is time, in minutes, and T is temperature in degrees Celsius including E 814/UL 1379 and E 1966/UL 2079.

E 814/UL 1379 tests a fire-retardant system for fire exposure, temperature change, and resilience and structural integrity after fire exposure (the latter is generally identified as "the Hose Stream test"). Fire exposure, resulting in an F [Time] rating, identifies the time duration—rounded down to the last completed hour, along the Cellulosic curve before flame penetrates through the body of the system, provided the system also passes the hose stream test. Common F ratings include 1, 2, 3 and 4 hours but up to 8 hours may be required. Temperature change, resulting in a T [Time] rating, identifies the time for the temperature of the unexposed surface of the system, or any penetrating object, to rise 181° C. above its initial temperature, as measured at the beginning of the test. The rating is intended to represent how long it will take before a combustible item on the non-fireside will catch on fire from heat transfer. In order for a system to obtain a UL 1379 listing, it must pass both the fire endurance (F rating) and the Hose Stream test. The temperature data is only relevant where building codes require the T to equal the F-rating.

When required, the Hose Steam test is performed after the fire exposure test is completed. In some tests, such as UL 2079, the Hose Stream test is required with wall-to-wall and head-of-wall joints, but not others. This test assesses structural stability following fire exposure as fire exposure may affect air pressure and debris striking the fire-resistant system. The Hose Stream uses a stream of water. The stream is to be delivered through a 64 mm hose and discharged though a National Standard playpipe of corresponding size equipped with a 29 m discharge tip of the standard-taper, smooth-bore pattern without a shoulder at the orifice consistent with a fixed set of requirements:

| Hourly Fire Rating Time in Minutes | Water Pressure (kPa) | Duration of Hose Stream Test (sec./m$^2$) |
|---|---|---|
| 240 ≤ time < 480 | 310 | 32 |
| 120 ≤ time < 240 | 210 | 16 |
| 90 ≤ time < 120 | 210 | 9.7 |
| time < 90 | 210 | 6.5 |

The nozzle orifice is to be 6.1 m from the center of the exposed surface of the joint system if the nozzle is so located that, when directed at the center, its axis is normal to the surface of the joint system. If the nozzle is unable to be so located, it shall be on a line deviating not more than 30° from the line normal to the center of the joint system. When so located its distance from the center of the joint system is to be less than 6.1 m by an amount equal to 305 mm for each 10° of deviation from the normal. Some test systems, including UL 1379 and UL 2079 also provide for air leakage and water leakage tests, where the rating is made in conjunction with a L and W standard. These further ratings, while optional, are intended to better identify the performance of the system under fire conditions.

When desired, the Air Leakage Test, which produces an L rating and which represents the measure of air leakage through a system prior to fire endurance testing, may be conducted. The L rating is not pass/fail, but rather merely as system property. For Leakage Rating test, air movement through the system at ambient temperature is measured. A second measurement is made after the air temperature in the chamber is increased so that it reaches 177° C. within 15 minutes and 204° C. within 30 minutes. When stabilized at the prescribed air temperature of 204±5° C., the air flow through the air flow metering system and the test pressure difference are to be measured and recorded. The barometric pressure, temperature and relative humidity of the supply air are also measured and recorded. The air supply flow values are corrected to standard temperature and pressure (STP) conditions for calculation and reporting purposes. The air leakage through the joint system at each temperature exposure is then expressed as the difference between the total metered air flow and the extraneous chamber leakage. The air leakage rate through the joint system is the quotient of the air leakage divided by the overall length of the joint system in the test assembly.

When desired, the Water Leakage Test produces a W pass-fail rating and which represents an assessment of the watertightness of the system, can be conducted. The test chamber for or the test consists of a well-sealed vessel sufficient to maintain pressure with one open side against which the system is sealed and wherein water can be placed in the container. Since the system will be placed in the test container, its width must be equal to or greater than the exposed length of the system. For the test, the test fixture is within a range of 10 to 32° C. and chamber is sealed to the test sample. Nonhardening mastic compounds, pressure-sensitive tape or rubber gaskets with clamping devices may be used to seal the water leakage test chamber to the test assembly. Thereafter, water, with a permanent dye, is placed in the water leakage test chamber sufficient to cover the systems to a minimum depth of 152 mm. The top of the joint system is sealed by whatever means necessary when the top of the joint system is immersed under water and to prevent passage of water into the joint system. The minimum pressure within the water leakage test chamber shall be 1.3 psi applied for a minimum of 72 hours. The pressure head is measured at the horizontal plane at the top of the water seal. When the test method requires a pressure head greater than that provided by the water inside the water leakage test chamber, the water leakage test chamber is pressurized using pneumatic or hydrostatic pressure. Below the system, a white indicating medium is placed immediately below the system. The leakage of water through the system is denoted by the presence of water or dye on the indicating media or on the underside of the test sample. The system passes if the dyed water does not contact the white medium or the underside of the system during the 72-hour assessment.

Another frequently encountered classification is ASTM E-84 (also found as UL 723 and NFPA 255), Surface Burning Characteristics of Burning Materials. A surface burn test identifies the flam spread and smoke development within the classification system. The lower a rating classification, the better fire protection afforded by the system. These classifications are determined as follows:

| Classification | Flame Spread | Smoke Development |
|---|---|---|
| A | 0-25 | 0-450 |
| B | 26-75 | 0-450 |
| C | 76-200 | 0-450 |

UL 2079, Tests for Fire Resistant of Building Joint Systems, comprises a series of tests for assessment for fire resistive building joint system that do not contain other unprotected openings, such as windows and incorporates four different cycling test standards, a fire endurance test for the system, the Hose Stream test for certain systems and the optional air leakage and water leakage tests. This standard is used to evaluate floor-to-floor, floor-to-wall, wall-to-wall and top-of-wall (head-of-wall) joints for fire-rated construction. As with ASTM E-814, UL 2079 and E-1966 provide, in connection with the fire endurance tests, use of the Cellulosic Curve. UL 2079/E-1966 provides for a rating to the assembly, rather than the convention F and T ratings. Before being subject to the Fire Endurance Test, the same as provided above, the system is subjected to its intended range of movement, which may be none. These classifications are:

| Movement Classification (if used) | Minimum number of cycles | Minimum cycling rate (cycles per minute) | Joint Type (if used) |
|---|---|---|---|
| No Classification | 0 | 0 | Static |
| Class I | 500 | 1 | Thermal Expansion/Contraction |
| Class II | 500 | 10 | Wind Sway |
| Class III | 100 | 30 | Seismic |
| | 400 | 10 | Combination |

ASTM 2307, Standard Test Method for Determining Fire Resistance of Perimeter Fire Barrier Systems Using Intermediate-Scale, Multi-story Test Apparatus, is intended to test for a systems ability to impede vertical spread of fire from a floor of origin to that above through the perimeter joint, the joint installed between the exterior wall assembly and the floor assembly. A two-story test structure is used wherein the perimeter joint and wall assembly are exposed to an interior compartment fire and a flame plume from an exterior burner. Test results are generated in F-rating and T-rating. Cycling of the joint may be tested prior to the fire endurance test and an Air Leakage test may also be incorporated.

The expansion joint seal 100 may therefore perform wherein the bottom surface 804 at a maximum joint width increases no more than 181° C. after sixty minutes when the body 130 is exposed to heating according to the equation T=20+345*LOG(8*t+1), where t may be time in minutes and T may be temperature in C.

The joint seal 100 may also perform wherein the third core body bottom surface 132, having a maximum joint width of more than six (6), increases no more than 139° C. after sixty minutes when the joint seal 100 is exposed to heating according to the equation T=20+345*LOG(8*t+1), where t may be time in minutes and T may be temperature in C.

The joint seal 100 may be adapted to be cycled one of 500 times at 1 cycle per minute, 500 times at 10 cycles per minute and 100 cycles at 30 times per minute, without indication of stress, deformation or fatigue.

In other embodiments, the joint seal 100 is configured to pass hurricane force testing to TAS 202/203. Further the joint seal 100 may be designed or configured to pass ASTM E-282, E-331, E-330, E-547 or similar testing to meet the pressure cycling and water resistance requirements up to 5000 Pa or more.

As can be appreciated, the foregoing disclosure may incorporate or be incorporated into other expansion joint systems, such as those with fire retardant members in a side of the body 130 adjacent the substrate, the inclusion of a separate barrier within the body 130 and which may extended beyond the body 130 or remain encapsulated within, one or more longitudinal load transfer members atop or within the body 130, without or without support members, a cover plate, a spline or ribs tied to the cover plate whether fixedly or detachably, use of auxetic materials, or constructed to obtain a fire endurance rating or approval according to any of the tests known in the United States and Europe for use with expansion joint systems, including fire endurance, movement classification(s), load bearing capacity, air penetration and water penetration.

The foregoing disclosure and description is illustrative and explanatory thereof. Various changes in the details of the illustrated construction may be made within the scope of the appended claims without departing from the spirit of the invention. The present invention should only be limited by the following claims and their legal equivalents.

I claim:

1. An expansion joint seal for use in an expansion joint, the expansion joint having a first substrate separated from a second substrate by a joint width, comprising:

a cover plate, the cover plate having a cover plate length between a cover plate front surface and a cover plate back surface, a cover plate width between plate first surface and a cover plate second surface, the cover plate width greater than the joint width:

a rib, the rib having a rib width between a rib first surface and a rib second surface, a rib height between a rib top surface and a rib bottom surface, a rib length between a rib front surface and a rib back surface, the rib length not greater than the cover plate length;

a resilient compressible body, the resilient compressible body having a body uncompressed width between a body first outer surface and a body second outer surface, a body length between a body front surface and a body back surface, a body height between a body bottom surface and a body top surface, a body first section, a body second section, the body uncompressed width greater than the joint width, the body length not greater than the cover plate length, the body first section having a body first section first surface adapted to contact a first substrate wall, and a body first section second surface, the body second section having a body second section second surface adapted to contact a second substrate wall, and a body second section first surface;

the rib first surface in contact with at least a portion of the body first section second surface, the rib second surface in contact with at least a portion of the body second section first surface, the rib top surface detachably fixed in relation to the cover plate; and a resilient spacing member, the resilient spacing member having a resilient spacing member uncompressed width between a resilient spacing member uncompressed first outer surface and a resilient spacing member uncompressed second outer surface, the resilient spacing member uncompressed width greater than the joint width, a resilient spacing member length, the resilient spacing member length not greater than the cover plate length, the resilient spacing member having a resilient spacing member accordion profile across the resilient spacing member uncompressed width, the resilient spacing member adapted to contact to the rib adjacent the cover plate.

2. The expansion joint seal of claim 1 wherein the rib bottom surface is positioned below the body top surface and above the body bottom surface.

3. The expansion joint seal of claim 1, further comprising a resilient spacing member first surface member, a resilient spacing member second surface member, and a resilient spacing member bottom member, the resilient spacing member first surface member downwardly depending from the resilient spacing member, the resilient spacing member second surface member, downwardly depending from the resilient spacing member, the resilient spacing member bottom member attached to the resilient spacing member first surface member and the resilient spacing member second surface member, the resilient spacing, member surrounding the resilient compressible body.

4. The expansion joint seal of claim 3, further comprising a fire-retardant body intermediate the resilient spacing member and the body bottom surface.

* * * * *